US005820084A

United States Patent [19]

Trumbauer et al.

[11] Patent Number: 5,820,084

[45] Date of Patent: Oct. 13, 1998

[54] BABY BOTTLE SUPPORTING BIB

[76] Inventors: Denise S. Trumbauer; Jeffrey S. Trumbauer, both of 1051 Mill Hill Rd., East Greenville, Pa. 18041

[21] Appl. No.: 874,528

[22] Filed: Jun. 13, 1997

[51] Int. Cl.[6] ..... A47D 15/00

[52] U.S. Cl. ..... 248/102; 2/49.2

[58] Field of Search ..... 248/102, 104, 248/105, 106; 2/49.1, 49.2

[56] References Cited

U.S. PATENT DOCUMENTS

| | | | |
|---|---|---|---|
| 298,985 | 5/1884 | Kimball | 2/49.2 |
| D. 379,660 | 6/1997 | Aube | 248/105 X |
| 2,510,953 | 6/1950 | Brose et al. | 248/102 |
| 2,526,121 | 10/1950 | Curry et al. | 248/102 |
| 2,631,288 | 3/1953 | Daust | 248/102 X |
| 3,584,818 | 6/1971 | Essman | 248/105 |
| 3,850,393 | 11/1974 | Marquard | 248/102 |
| 4,405,106 | 9/1983 | Adler | 248/102 |
| 4,473,907 | 10/1984 | Maillard | 248/102 X |
| 4,564,957 | 1/1986 | Scharf | 2/49.2 X |
| 4,630,793 | 12/1986 | Hunter | 248/102 |
| 4,723,801 | 2/1988 | Musumeci et al. | 294/33 |
| 4,726,551 | 2/1988 | Randall | 248/102 |
| 4,809,938 | 3/1989 | Skinner et al. | 248/102 |
| 4,895,327 | 1/1990 | Malone et al. | 248/102 |
| 4,989,811 | 2/1991 | Millis et al. | 248/104 |
| 5,022,616 | 6/1991 | Kordecki | 248/106 |
| 5,184,796 | 2/1993 | Maher | 248/106 X |
| 5,188,320 | 2/1993 | Polka | 248/102 X |
| 5,192,041 | 3/1993 | Bryant | 248/104 |
| 5,397,039 | 3/1995 | Parcelles | 224/148 |
| 5,456,432 | 10/1995 | Ennis et al. | 248/102 |
| 5,489,075 | 2/1996 | Ibe | 248/104 |
| 5,582,335 | 12/1996 | Beard et al. | 224/148.5 |

*Primary Examiner*—Derek J. Berger
*Attorney, Agent, or Firm*—Michael F. Petock, Esq.

[57] ABSTRACT

A washable baby bottle holder is provided which is constructed of a washable cloth bib having mounted to its face a covered foam member with a groove or trough for holding the baby bottle. The washable cloth bib is provided with neck straps attached to the upper end and a pair of straps attached near the lower end which are gathered to secure the lower end of the bib to the trunk of the baby. On the face of the bib is a foam member having a groove or trough shaped and adapted to receive a baby bottle. The foam member is preferably covered by a washable cloth covering and secured to the face of the bib around the periphery of the foam member. The groove or trough is formed in the foam member such that the base of the groove projects further from the face of the bib near the lower end of the bib than near the upper end of the bib thereby directing the bottle for use in nursing the baby while the baby is seated or lying down. The strap is used for holding the baby bottle in the groove.

12 Claims, 2 Drawing Sheets

FIG. 3
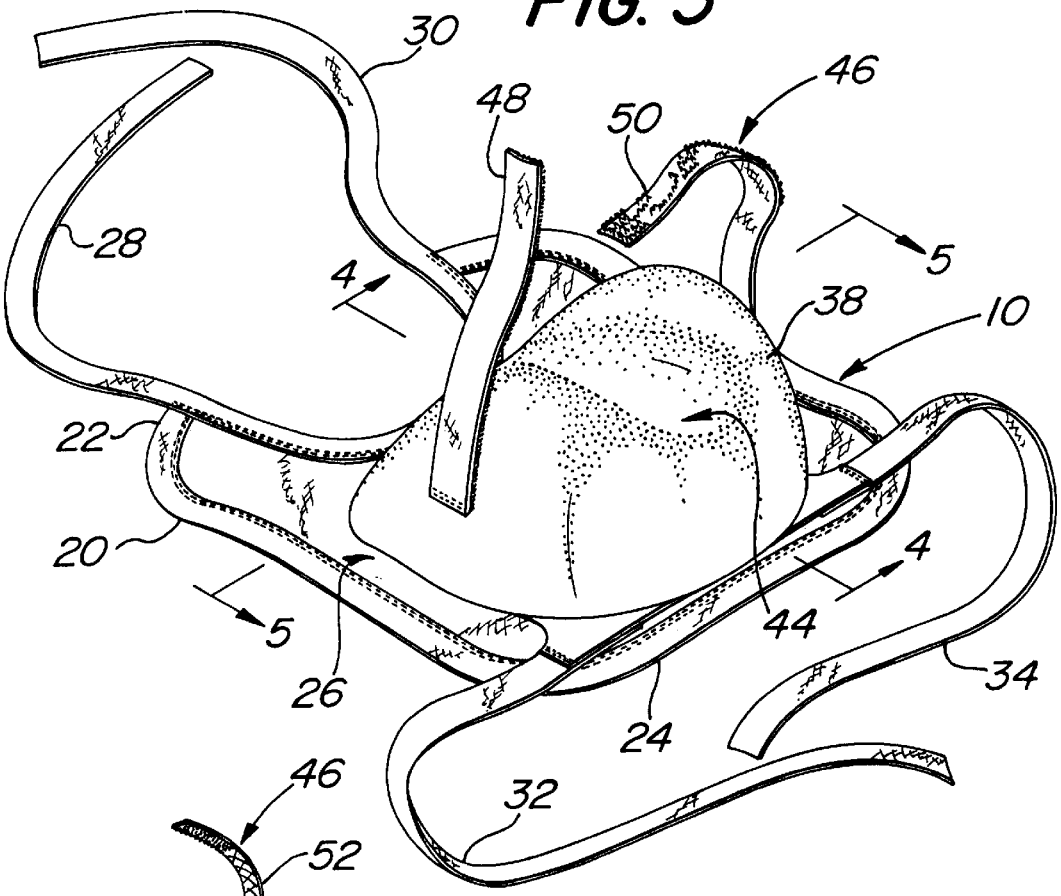
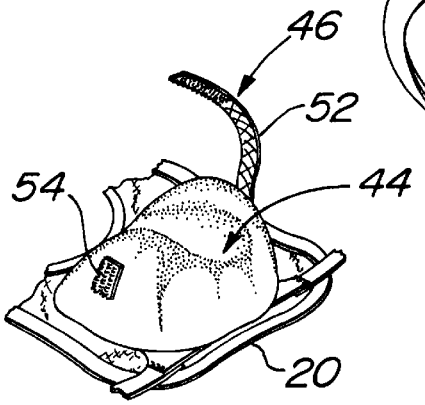
FIG. 4
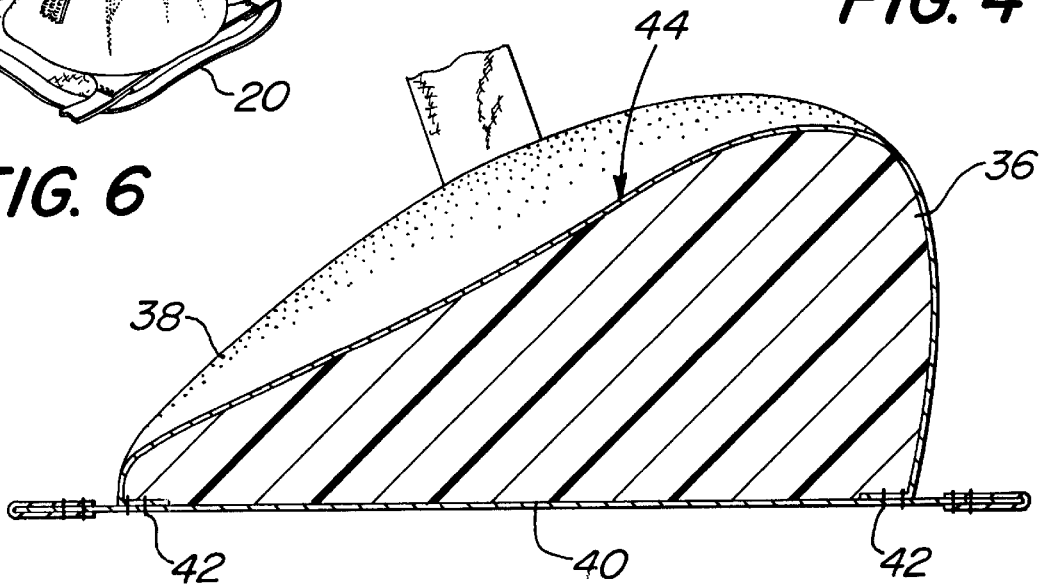
FIG. 6

BABY BOTTLE SUPPORTING BIB

FIELD OF THE INVENTION

The present invention relates to a washable holder for a baby bottle or nursing bottle. More particularly, the present invention relates to a washable baby bottle holder which may be formed on a bib.

BACKGROUND OF THE INVENTION

There has been a need in the past for a means for holding a baby bottle where a mother or caretaker does not have to hold the baby's bottle for nursing for extended periods of time. Further, there has been a need to provide a means for holding a baby bottle where the mother or caretaker may perform other functions such as driving a car or performing household functions.

A number of efforts have been made in the past to devise baby bottle holders. For example, see U.S. Pat. No. 4,726,551—Randall et al. wherein a baby bottle may be mounted to a plastic block attached to a flap of a body wrap device having a foam pillow for the baby's head attached thereto.

Prior art attempts have also included devices such as that shown in U.S. Pat. No. 2,510,953—Brose et al. wherein a baby bottle may be held within a flap which is attachable to a cushion which may be placed along side a baby. The cushion is not shaped nor adapted to be attached to the baby.

Attention is also directed to U.S. Pat. No. 4,405,106—Adler which utilizes a hingeable plastic plate which may be strapped to the baby and adjusted by a prop for adjusting the angle of the bottle.

U.S. Pat. No. 3,584,818—Essman discloses a baby bottle holder formed from a block of polyurethane material in which a baby bottle is inserted in a bore in the foam material. The baby may lay its head on a flap extending from the block of foam for nursing from the bottle.

Various other attempts have been made in the prior art with respect to providing baby bottle holders.

However, none of the prior art discloses an inexpensive, completely washable, soft and safe baby bottle holder which may be directly attached to the baby and utilized for nursing of the baby in both the supine and seated positions.

SUMMARY OF THE INVENTION

The present invention provides the advantage of a completely washable baby bottle holder.

Another advantage of the present invention is that it provides a baby bottle holder without any rigid structures which could cause discomfort or harm to the baby.

Another advantage of the present invention is that it is attachable to the baby in a safe and effective manner.

Another advantage of the present invention is that it may be utilized to nurse the baby in both the seated and the supine positions.

Briefly and basically, in accordance with the present invention, a baby bottle holder is provided which includes a washable cloth member or bib having a face extending from an upper end to a lower end and a pair of neck straps attached to the upper end. The holder further includes a grooved foam member mounted to the face of the bib by a washable cloth covering. The washable cloth covering is secured to the face of the bib around the periphery of the foam member. The grooved foam member is provided with a groove or trough shaped and adapted to receive a baby bottle. A grooved foam member is shaped such that the groove therein projects farther from the face of the bib near the lower end of the bib than near the upper end of the bib. A strap is provided for holding the baby bottle in the groove. This may be a pair of straps which attach together over the baby bottle or may be a single strap, elastic or non-elastic, which runs over the bottle from one side to the other. A pair of straps is also provided near the lower end of the bib and adapted to secure the lower end of the cloth member or bib to the trunk of the baby.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

FIG. 3 is a view in perspective of a baby bottle supporting bib in accordance with the present invention.

FIG. 4 is a cross-sectional view taken along line 4—4 of FIG. 3.

FIG. 6 is a broken away view in perspective of an alternate embodiment of the present invention showing another arrangement of a retaining strap for a baby bottle which may be elastic.

DETAILED DESCRIPTION OF THE PREFERRED EMBODIMENTS

Figure 1:
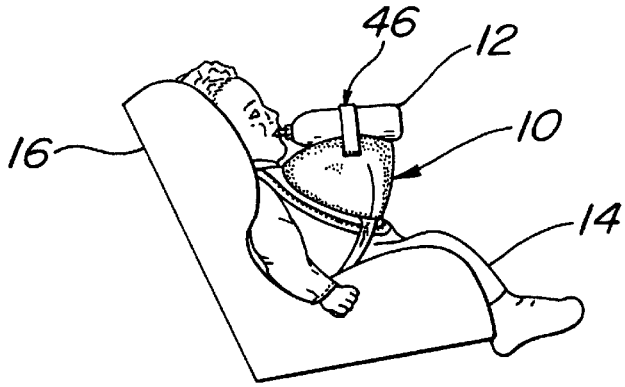
FIG. 1 is a side elevation view of a baby bottle supporting bib in accordance with the present invention being utilized by a baby for nursing in a seated position.

Referring now to the drawings wherein like numerals indicate like elements, there is shown in FIG. 1 a baby bottle supporting bib 10 being used to support a baby or nursing bottle 12. Baby 14 is shown utilizing baby bottle supporting bib 10 in a seated position, such as for example, in a car seat 16.

Figure 2:
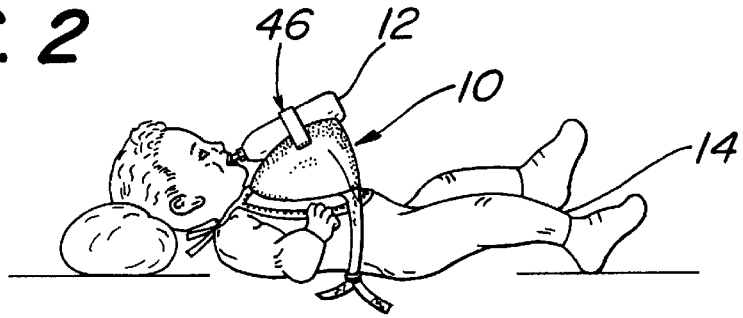
FIG. 2 is a side elevation view of a baby bottle supporting bib in accordance with the present invention being utilized by a baby for nursing in a supine position.

Referring now to FIG. 2, there is illustrated the baby bottle supporting bib 10 being utilized to support and hold baby bottle 12 for a baby 14 in a supine position.

Referring now to FIG. 3, there is shown a baby bottle supporting bib 10 in perspective and in greater detail. Baby bottle supporting bib 10 may be constructed utilizing a washable cloth member or a washable cloth bib 20 having a face extending from an upper end 22 to a lower end 24. In a presently preferred form of the invention, the baby bottle supporting bib could be constructed from a conventional bib made of terry cloth or the like with structure added to it, but it is understood that any other suitable flat piece of washable fabric or material may be utilized to form a sheet or member having a face 26 extending from an upper end 22 to a lower end 24.

Attached to the washable cloth member or bib 20 at or near the upper end 22 are a pair of neck straps 28 and 30. Neck straps 28 and 30 are adapted to be secured around the baby's neck in any suitable manner including tying or by the use of velcro fasteners, snaps, buttons or the like which are not shown. In a similar manner, a pair of straps 32 and 34 are attached to the lower end of member or bib 20. Straps 32 and 34 may be attached to member 20 by sewing or any other suitable means, including adhesive means. Again, straps 32 and 34 may be secured around the trunk of the baby by any suitable means, including the tying together of the ends of lower straps 32 and 34, or by any suitable fastening means including, for example, velcro fasteners, snaps, buttons or the like.

Figure 5:
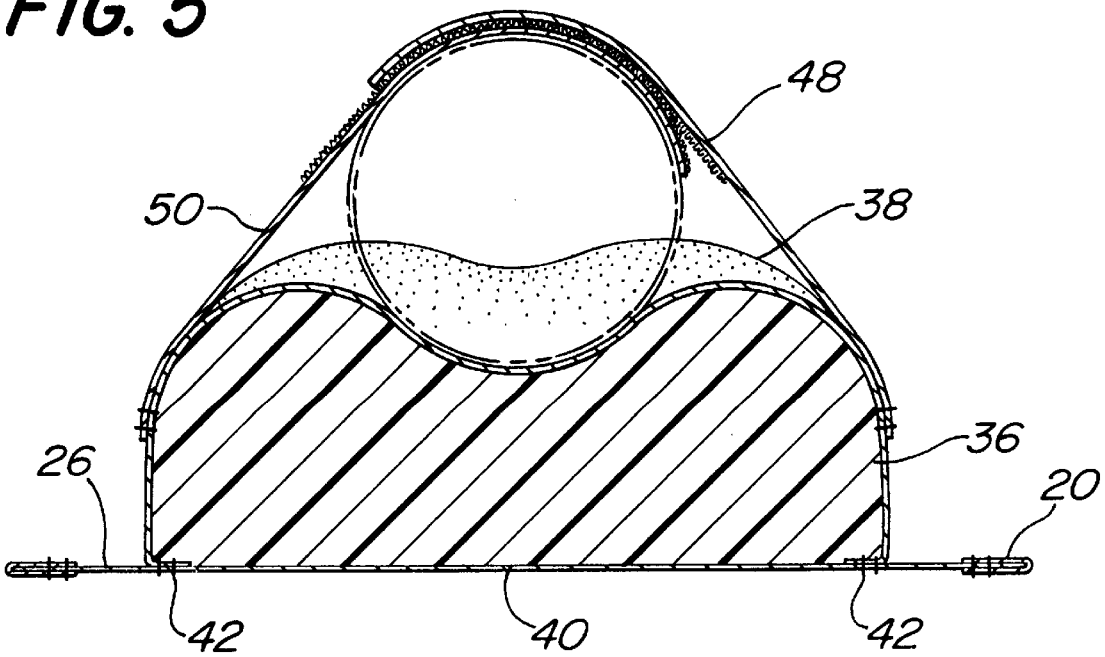
FIG. 5 is a cross-sectional view taken along Line 5—5 of FIG. 3.

Referring now to FIGS. 4 and 5 taken in conjunction with FIG. 3, a grooved or troughed foam member 36 is attached to face 26 of member or bib 20. Grooved or troughed foam member may preferably be secured to face 26 and member 20 by a washable cloth covering 38. Although foam member 38 may be secured to face 26 by adhesive along its back edge or lower face 40, preferably, the foam member 36 is secured by sewing cloth covering 38 to member 20 around the periphery of foam member 38 as shown at 42. As may be seen in FIGS. 3–6, substantially the entire lower face 40 is mounted to face 26 of cloth member 20.

Foam member 36 is provided with a groove or trough 44 as may be best seen in FIGS. 3–6, which groove or trough 44 is an open top groove shaped and adapted to receive a baby bottle. Groove or trough 44 is shaped such that groove 44 projects further from the face 26 of cloth member 20 or bib 20 near the lower end 24 of cloth member 20, than it does near the upper end of cloth member 20. In other words, the lower end of the groove is raised such that it projects further from the trunk of the baby such that the lower end of the bottle will tend to be elevated or raised as contrasted to a flat bib. In this manner, a baby may feed in either a prone or seated position.

In accordance with the present invention, the entire baby bottle supporting bib is soft and washable. There are no rigid parts which could injure or make the baby uncomfortable. Further, the entire baby bottle supporting structure is washable. The entire baby bottle supporting bib may be placed in a washing machine and dryer for quick and efficient washing.

The baby bottle may be secured in the cloth covered grooved foam member 36 by means of a suitable strap structure 46. As illustrated in FIG. 3, strap structure 46 may be comprised of straps 48 and 50 which may be secured together by hook and loop cloth fasteners such as those commercially available under the trademark Velcro. An alternate arrangement of straps structure 46 is shown in FIG. 6 wherein a single strap 52 may be attachable to the mating portion of a hook and loop type cloth fastener 54. Strap 52 may be an elastic strap which could provide pressure on the baby bottle under varying conditions. Alternatively, strap 52 may be non-elastic and may be adjusted for suitable tightness by means of adjustment between an extended portion of hook or loop fastener material on strap 52.

It is understood that the cloth member 20, the cloth covering 38 and the straps may be made of any suitable soft washable material. It is preferred that such material be made of cotton or the like, but any suitable material, synthetic or natural, may be utilized so long as it is soft and washable. Various materials may be available which may be referred to as cloth which meet the characteristics required herein and are intended to be covered by the claims attached hereto.

The present invention may be embodied in other specific forms without departing from the spirit or essential attributes thereof and, accordingly, reference should be made to the appended claims, rather than to the foregoing specification as indicating the scope of the invention.

We claim:

1. A baby bottle holder, comprising:

a washable fabric cloth member having a face extending from an upper end to a lower end and a pair of neck straps attached to said upper end;

a grooved foam member having a lower face, wherein substantially the entire lower face is mounted to the face of said washable fabric cloth member by a washable fabric cloth covering, said washable fabric cloth covering being secured to said face of said fabric cloth member around a periphery of said foam member, said grooved foam member having an open top groove shaped and adapted to receive a baby bottle, said grooved foam member being shaped such that said groove therein projects farther from the face of said fabric cloth member near the lower end of said fabric cloth member than near the upper end of said fabric cloth member;

strap means for holding said baby bottle in said groove;

a pair of straps made of fabric attached near the lower end of said cloth member and adapted to secure the lower end of said cloth member to the trunk of a baby; and whereby said baby bottle holder is adapted to be used in a plurality of positions.

2. A baby bottle holder in accordance with claim 1 wherein said strap means for holding said baby bottle in said groove is comprised of a first and a second strap, each of said first and second straps being attached to said washable fabric cloth covering and being attachable to each other by means of hook and loop cloth fasteners.

3. A baby bottle holder in accordance with claim 1 wherein said strap means for holding said baby bottle in said groove is comprised of an elastic strap.

4. A baby bottle holder in accordance with claim 1 wherein said strap means for holding said baby bottle in said groove is comprised of a first and second strap releasably attachable together by means of a cloth hook and loop fastener.

5. A baby bottle holder, comprising:

a washable fabric cloth bib having a face extending from an upper end to a lower end and a pair of neck straps attached to said upper end;

a grooved foam member having a lower face, wherein substantially the entire lower face is mounted to the face of said bib by a washable fabric cloth covering, said washable fabric cloth covering being secured to said face of said bib around a periphery of said foam member, said grooved foam member having an open top groove shaped and adapted to receive a baby bottle, said grooved foam member being shaped such that said groove therein projects farther from the face of said bib near the lower end of said bib than near the upper end of said bib;

strap means for holding said baby bottle in said groove;

a pair of straps made of fabric attached near the lower end of said bib and adapted to secure the lower end of said bib to the trunk of a baby; and whereby said baby bottle holder is adapted to be used in a plurality of positions.

6. A baby bottle holder in accordance with claim 5 wherein said strap means for holding said baby bottle in said groove is comprised of a first and a second strap, each of said first and second straps being attached to said washable fabric cloth covering and being attachable to each other by means of hook and loop cloth fasteners.

7. A baby bottle holder in accordance with claim 5 wherein said strap means for holding said baby bottle in said groove is comprised of an elastic strap.

8. A baby bottle holder in accordance with claim 5 wherein said strap means for holding said baby bottle in said groove is comprised of a first and second strap releasably attachable together by means of a cloth hook and loop fastener.

9. A baby bottle holder, comprising:

a washable fabric cloth member having a face extending from an upper end to a lower end and a pair of neck straps attached to said upper end;

a grooved foam member having a lower face, wherein substantially the entire lower face is mounted to the face of said washable cloth member by a washable cloth covering, said washable cloth covering being secured to said face of said washable fabric cloth member around a periphery of said foam member, said grooved foam member having an open top groove shaped and adapted to receive a baby bottle, said grooved foam member shaped such that said foam member has a first predetermined thickness near the lower end of said fabric cloth member and a second predetermined thickness near the upper end of said fabric cloth member such that said groove in the foam member projects farther from the face of said fabric cloth member near the lower end of said cloth member than near the upper end of said fabric cloth member;

strap means for holding said baby bottle in said groove;

a pair of straps attached near the lower end of said fabric cloth member and adapted to secure the lower end of said fabric cloth member to the trunk of a baby; and said first predetermined thickness and said second predetermined thickness being selected such that fluid may flow from said baby bottle when said baby is in a substantially supine position and when said baby is in a seated position.

10. A baby bottle holder in accordance with claim 9 wherein said strap means for holding said baby bottle in said groove is comprised of a first and a second strap made of fabric, each of said first and second straps being attached to said washable fabric cloth covering and being attachable to each other by means of hook and loop cloth fasteners.

11. A baby bottle holder in accordance with claim 9 wherein said strap means for holding said baby bottle in said groove is comprised of an elastic strap.

12. A baby bottle holder in accordance with claim 9 wherein said strap means for holding said baby bottle in said groove is comprised of a first and second strap releasably attachable together by means of a cloth hook and loop fastener.

* * * * *